US007335628B2

(12) United States Patent
Crump et al.

(10) Patent No.: US 7,335,628 B2
(45) Date of Patent: Feb. 26, 2008

(54) CLEANING COMPOSITION FOR CLEANING A PRINTING PRESS

(76) Inventors: Judson Eric Crump, 406 Westlake Ct., Niceville, FL (US) 32578; Peter Kueth, 1524 Glendale Cir., Niceville, FL (US) 32578

( * ) Notice: Subject to any disclaimer, the term of this patent is extended or adjusted under 35 U.S.C. 154(b) by 31 days.

(21) Appl. No.: 11/164,934

(22) Filed: Dec. 12, 2005

(65) Prior Publication Data

US 2007/0135328 A1 Jun. 14, 2007

(51) Int. Cl.
*C11D 3/22* (2006.01)
*C11D 3/36* (2006.01)
*C11D 3/382* (2006.01)

(52) U.S. Cl. ..... 510/174; 510/170; 510/171; 510/172; 510/470; 510/463; 510/468

(58) Field of Classification Search ..... 510/170, 510/171, 172, 174, 470, 463, 468
See application file for complete search history.

(56) References Cited

U.S. PATENT DOCUMENTS

| | | | | |
|---|---|---|---|---|
| 5,156,760 | A * | 10/1992 | Marchese et al. | 510/214 |
| 5,158,710 | A | 10/1992 | Van Eenam | |
| 5,340,493 | A | 8/1994 | Principato | |
| 5,437,808 | A | 8/1995 | Weltman et al. | |
| 5,665,690 | A | 9/1997 | Lucas et al. | |
| 6,090,238 | A * | 7/2000 | Smith | 156/344 |
| 6,566,316 | B2 * | 5/2003 | Hiatt et al. | 510/210 |
| 6,706,676 | B2 | 3/2004 | Swensen | |

* cited by examiner

*Primary Examiner*—Charles Boyer

(57) ABSTRACT

Disclosed is a cleaning composition for removing ink from a variety of surfaces, but more particularly from rubber. The composition has a high evaporation rate, is completely biodegradable, environmentally safe, not harmful to rubber, and has a near neutral pH.

4 Claims, No Drawings

CLEANING COMPOSITION FOR CLEANING A PRINTING PRESS

FIELD OF THE INVENTION

The herein disclosed invention finds applicability in the field of cleaning agents. More particularly the cleaning compositions of the herein disclosed invention find applicability for cleaning surfaces, more particular rubber, of ink of various formulations and more particular as a printing press cleaner.

BACKGROUND OF INVENTION

There is a need in the field of cleaning agents and particularly in the field of cleaning agents for printing presses that will not degrade the rubber and that are safe to handle and environmentally friendly. As the preferred method of disposing of the removed ink and cleaning compositions is down the wastewater drain, without pretreatment, a safe, biodegradable cleaning composition is needed. There is also a need in this particular field for an environmentally friendly cleaning composition due to the high cost of disposing of cleaning cloths, used with non-environmentally friendly cleaning compositions, in an EPA approved manner. This practice requires printing businesses to hire outside cleaning companies with closed system washers to clean and dispose of the cloths used to wipe the presses. It is cheaper to buy new cleaning cloths, but disposing of the used cleaning cloths would violate EPA policy and result in a substantial fine if the cleaning procedure was not carried out.

By combining the composition disclosed in this patent with one of the readily available soy-based inks, already in use by most newspapers, the cost of cleaning the cloths will be avoided without violating the EPA policy at issue.

Presently, many cleaners being used are of high pH, contain ethylene glycol ethers, and/or are generally not stable emulsions. Some wastewater treatment plants do not want to accept Lucas, U.S. Pat. No. 5,665,690:

The specification in U.S. Pat. No. 5,665,690 states that the composition be a "homogeneous, single phase solvent composition," and therefore not an emulsion. Additionally, U.S. Pat. No. 5,665,690 proposes the use of a glycol ether as a secondary solvent alongside d-limonene. The present invention claims no co-solvent other than ethanol or water, and therefore falls outside the scope of U.S. Pat. No. 5,665,690.

Weltman, et al., U.S. Pat. No. 5,437,808:

Weltman teaches against the use of water in the composition proposed in U.S. Pat. No. 5,437,808. The composition claimed by U.S. Pat. No. 5,437,808 contains both esters and ethers. The proposed invention contains no esters and no ethers, and actually teaches against the use of esters because of their incompatibility with many of the elastomers used by the printing industry.

Swensen, U.S. Pat. No. 6,706,676

Swensen teaches the use of a standard anionic detergent emulsifier which is slow to biodegrade and is not environmentally friendly, whereas the current invention uses alkylated polyglucosides which are derived from sugars and plant oils and are quickly biodegradable and totally environmentally friendly. Prior art patent U.S. Pat. No. 6,707,676 contains monoethanolamine, a chemical that is toxic, corrosive, and flammable. Monoethanolamine is used to assist in ink dissolution and emulsion stability. The present invention uses ethanol or water to accomplish both of these goals with increased effectiveness and considerably improved safety. The current invention has superior material compatibility. Most organic solvents capable of removing ink from such rollers and sheets will swell or deteriorate the rubber of which they are composed. Some of the ingredients in the composition proposed by U.S. Pat. No. 6,706,676 are dibasic esters. Esters are highly incompatible with most natural and synthetic rubbers, including the type of rubber comprising most print rollers and sheets: NBR or nitrile butadiene rubber.

An ingredient in U.S. Pat. No. 6,706,676 used as an emulsifier is dodecylbenzene sulfonate. Though compatibility tests for elastomers with dodecylbenzene sulfonate have not been published, the very closely related chemical dodecylbenzene has been found to be highly incompatible with most types of rubber, including NBR. Our cleaning composition lacks any such ingredient, and instead uses mild, but effective surfactants to accomplish the same task.

One of the most common complaints made by pressmen about environmentally responsible cleaning systems is that they are too slow to evaporate. Slow evaporation means more time spent cleaning the press, and therefore less efficient pressroom operation. Our cleaning composition is designed to evaporate quickly without reducing effectiveness and safety. One of the stated goals of prior art patent U.S. Pat. No. 6,706,676 is to produce a composition "mainly of low volatility components". Low volatility equals slow evaporation which equals less efficient pressroom operation.

BRIEF SUMMARY OF THE INVENTION

The invention is directed to a cleaning composition and more particularly, to an ink cleaning composition containing effective amount of: water, dipentene, ethanol, lecithin, and alkylated polyglucosides. The inventor has found the composition of this invention to effective for cleaning nearly every type of ink on nearly every type of printing press and other surfaces. The composition can be used as a pressroom cleaner and more particularly for removing ink from printing presses without damaging their rubber components. The composition can be used with a variety of inks, but when combined with a soy-based ink the result is an environmentally friendly printing solution.

The cleaning composition may have dipentene replaced wither wholly or in part with D-limonene, alph-pinene or beta-pinene. such a high pH effluent as it interferes with the wastewater treatment processes, often killing useful bacteria or damaging equipment. The use of ethylene glycol ethers present a health hazard to workers cleaning the presses who may inhale it or absorb it through the skin. Most if not all other d-limonene cleaning solutions result in unstable emulsions. The present invention is more stable. This is important in that it removes a step from the cleaning process, as the composition does not have to be shaken prior to use. There is also the problem previously mentioned that all other cleaning compositions in this field are either non-biodegradable or contain toxic elements. The present invention is both easily biodegradable and contains no toxic elements.

PRIOR ART PATENTS

Principato, U.S. Pat. No. 5,340,493:

Principato teaches the use of "a base solvent from about 20 to 95 weight percent of tall oil fatty acid ester." Fatty acid esters are generally incompatible with NBR, the type of rubber of which most print rollers and sheets are made, and therefore are not suitable for use on such equipment.

VanEenam, U.S. Pat. No. 5,158,710:

In addition to the present invention's lack of the alkali builders used in U.S. Pat. No. 5,158,710, the cleaning composition proposed in U.S. Pat. No. 5,158,710 specifically claims a solvent that is "not a hydrocarbon". Both D-limonene and dipentene are hydrocarbons, and therefore are outside the scope of this patent. Furthermore, U.S. Pat. No. 5,158,710 specifies that the solvent used in the composition must have a water solubility of "approximately 0.2 to approximately 6 weight percent". Again, both D-limonene and dipentene have water solubilities of less than 0.2 weight percent, and fall outside of the scope of this patent.

EXAMPLES

The invention envisions a composition useful for cleaning affected surfaces comprising effective amounts of:

Water,
Dipentene,
Ethanol,
Lecithin,and
Alkylated Polyglucosides.

The amounts set forth herein are exemplary of effective amounts.

The invention envisions a composition containing substantially the percentage ranges set forth as follows.

| Ingredient | Percentage (by volume) |
|---|---|
| Water | 35–51 |
| Dipentene | 40–55 |
| Ethanol | 5–15 |
| Lecithin | 0.1–2.5 |
| Alkylated Polyglucosides | 0.1–2.5 |

A preferred embodiment of the cleaning composition is substantially set forth as follows:

| Ingredient | Percentage (by volume) |
|---|---|
| Water | 35–51 |
| Dipentene | 40–55 |
| Ethanol | 10–13 |
| Lecithin | 0.1–0.5 |
| Alkylated Polyglucosides | 0.1–0.5 |

ADVANTAGES AND BENEFITS DERIVED FROM THE USE OF THIS INVENTION

Users will be required to use less of the present invention than other cleaning compositions as it contains higher amounts of active ingredients than other cleaning compositions in this field. Printing businesses will have to replace the rubber rollers and components on their printing presses less often as our product is not detrimental to rubber. Users will be able to dispose of their ink in conjunction with a soy-based ink, as the current invention is completely biodegradable and environmentally friendly. Printing businesses will eliminate the substantial cost of hiring outside cleaning companies to dispose of their cleaning cloths in an EPA approved manner. Users who clean with the present invention will be at lower risk for health problems as the present invention does not contain toxic substances. Printing businesses will have less downtime as the present invention evaporates quickly.

What is claimed is:

1. A cleaning composition for cleaning affected surfaces comprising effective amounts of: dipentene, ethanol, lecithin, and alkylated polyglucosides.

2. The cleaning composition of claim 1, further comprising water.

3. The cleaning composition of claim 2, comprising:
about 35-51% by volume water;
about 40-55% by volume dipentene;
about 5-15% by volume ethanol;
about 0.1-2.5% by volume lecithin; and
about 0.1-2.5% by volume alkylated polyglucosides.

4. The cleaning composition of claim 3, comprising:
about 35-51% by volume water;
about 45-51% by volume dipentene;
about 10-13% by volume ethanol;
about 0.1-0.5% by volume lecithin; and
about 0.1-0.5% by volume alkylated polyglucosides.

* * * * *